United States Patent [19]

Lusch et al.

[11] Patent Number: 4,481,015

[45] Date of Patent: Nov. 6, 1984

[54] COAL-WATER SUSPENSIONS, A METHOD FOR THEIR PRODUCTION, AND THEIR USE

[75] Inventors: Jürgen Lusch, Oberhausen; Bernhard Lieder, Bottrop; Heinrich Heinen, Oberhausen; Wolfgang Kolodzey, Duisburg, all of Fed. Rep. of Germany

[73] Assignee: Ruhrchemie Aktiengesellschaft, Oberhausen, Fed. Rep. of Germany

[21] Appl. No.: 382,993

[22] Filed: May 28, 1982

[30] Foreign Application Priority Data

Jun. 3, 1981 [DE] Fed. Rep. of Germany ..... 3121979

[51] Int. Cl.[3] ..... C10L 1/32; C10J 3/46

[52] U.S. Cl. ..... 48/202; 44/51; 48/DIG. 7; 241/21; 241/30; 241/34

[58] Field of Search ..... 48/DIG. 7, 202; 44/51; 406/19, 31; 241/21, 30, 36, 35, 34

[56] References Cited

U.S. PATENT DOCUMENTS

| | | | |
|---|---|---|---|
| 2,824,701 | 2/1958 | Vester et al. | 241/34 |
| 2,833,482 | 5/1958 | Weston et al. | 241/34 |
| 3,094,289 | 6/1963 | Fahlstrom et al. | 241/34 |
| 3,352,499 | 11/1967 | Campbell, Jr. | 241/21 |
| 3,358,938 | 12/1967 | Brown | 241/21 |
| 4,067,503 | 1/1978 | Broman | 241/30 |
| 4,282,006 | 8/1981 | Funk | 48/DIG. 7 |

FOREIGN PATENT DOCUMENTS

| | | | |
|---|---|---|---|
| 145078 | 2/1961 | U.S.S.R. | 241/34 |
| 633605 | 11/1978 | U.S.S.R. | 241/34 |

OTHER PUBLICATIONS

Nakabayashi et al., "Production of Stable Slurry of Milled Coal and Hydrocarbon Oil", Mar. 12, 1980, U.K. Published Patent Application.

*Primary Examiner*—S. Leon Bashore
*Assistant Examiner*—K. M. Hastings
*Attorney, Agent, or Firm*—Sprung, Horn, Kramer & Woods

[57] ABSTRACT

The present invention relates to a method for producing pumpable coal-water suspensions by grinding pre-comminuted coal with water in a packed column in a ratio corresponding to the composition of the suspension ready for use. The addition of water or coal is controlled by measuring the density of the suspension leaving the mill, and the grain size of the coal particles is controlled by measuring the viscosity of the suspension. The density and viscosity of the coal-water suspension are simultaneously mutually adjusted. The addition of additives to the water is regulated according to the amount of coal added to the mill. The coal-water suspension can be fed to a coal gasification reactor without substantially changing the relative amounts of coal and water in said suspension.

9 Claims, 1 Drawing Figure

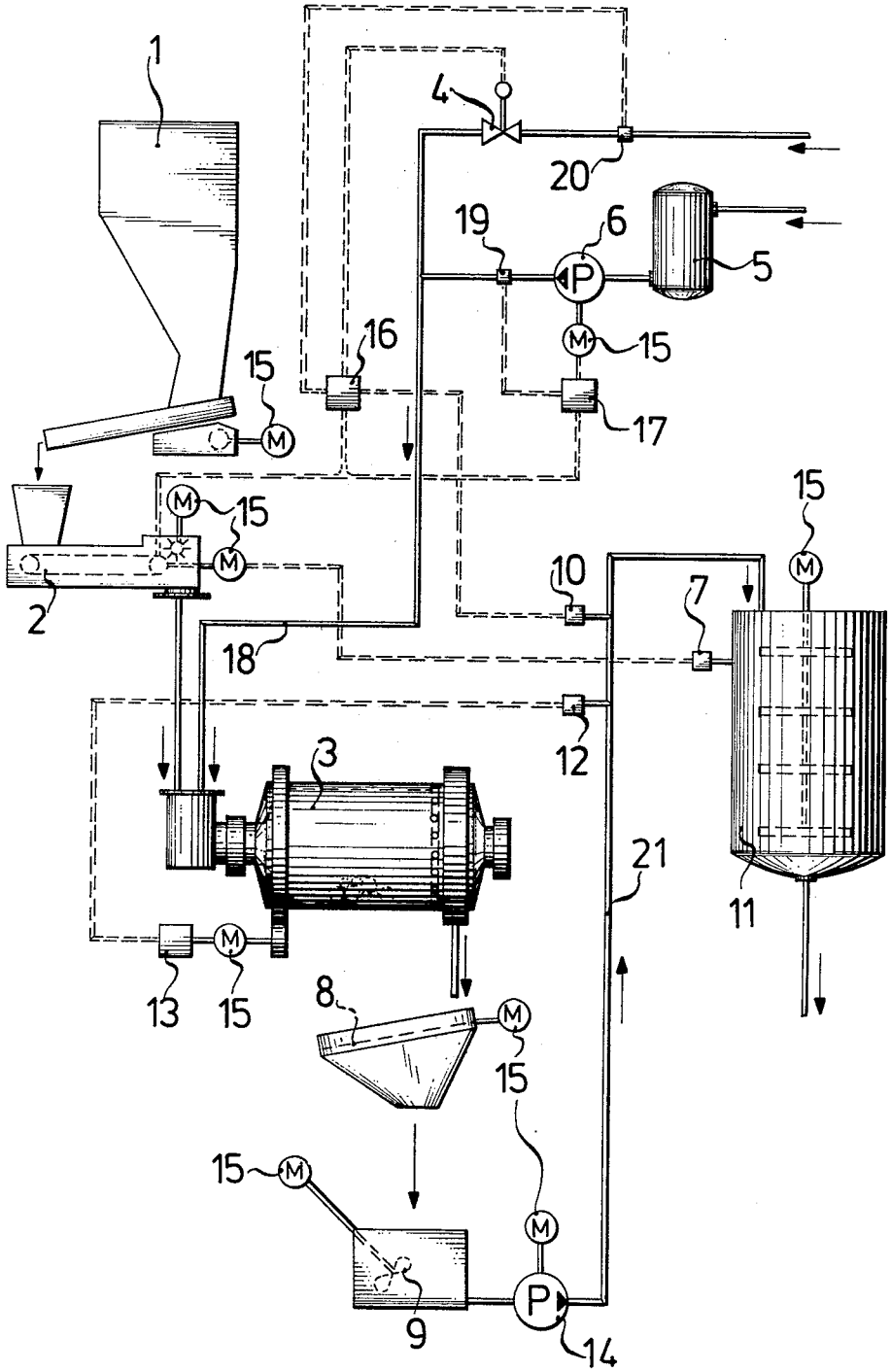
1
4
20
19
6
5
16
15
17
2
18
10
7
12
3
21
11
13
8
9
14

COAL-WATER SUSPENSIONS, A METHOD FOR THEIR PRODUCTION, AND THEIR USE

BACKGROUND OF THE INVENTION

1. Field of the Invention

The present invention relates to the production of pumpable coal-water suspensions in one process stage.

2. Discussion of Prior Art

Coal-water suspensions serve not only to transport pulverulent coal, but can also be used as a fuel for direct combustion in power-stations. Compared with coal-dust they have the advantage that the individual burners can be uniformly charged and the fuel line can be metered and monitored.

A further area of use for coal-water suspensions which is becoming of increasing importance is the gasification of hard coal or brown coal (lignite), i.e., its partial combustion with oxygen or oxygen-containing gases in the presence of water to form mixtures of carbon monoxide and hydrogen.

In this, fine-grained or pulverulent coal is converted at temperatures of about 900° to about 2000° C., preferably 1100° to 1600° C. and under elevated pressures of up to 200 bars, preferably 5 to 100 bars. Operating with fine-grained coal is particularly advantageous because modern mechanized coal mining methods have given rise to an increasing proportion of pulverulent coal. A further advantage is that pulverulent coal of practically any quality can be converted into synthesis gas irrespective of its tendency to cake and its ash content.

A typical example of a coal gasification process using fine-grained coal suspended in water is described in German Pat. No. 20 44 310. In this process coal is pre-ground dry in a mill and led to a suspension vessel. A stable, pumpable suspension is produced by adding fresh water and circulation water. This suspension is continuously pumped under the pressure of the gasification process to the burner and converted into carbon monoxide and hydrogen. Slag is formed as a by-product.

In the interests of higher energy yield in the form of carbon monoxide and hydrogen as well as process steam and a low oxygen consumption, special requirements are placed on the properties of suspensions intended to be used in coal gasification plants.

It is particularly important for the solids level of the suspension to be as high as possible, since this insures that the amount of energy to be supplied autothermally for heating that proportion of the water not involved in the reaction but only serving to transport the solids particles remains small. Furthermore, it is essential that the particle size of the solid material is sufficiently fine in order to insure its rapid conversion. This latter requirement conflicts with the fact that the viscosity of the suspension rises with decreasing particle size but must not exceed certain limiting values if the suspension is to be satisfactorily conveyed.

Coal-water suspensions which can be used in coal gasification processes are already known. Thus, suspensions are described in German Offenlegungschrift 28 36 440 which contain up to 75% by weight of solids and consist of solids particles the major proportion of which has a size of between 50 500 μm. Such suspensions have indeed been successfully employed in coal gasification processes, but do not satisfy all the above-mentioned requirements. In particular, they do not enable an almost complete conversion of all the coal contained in the suspension to be achieved.

It is also known to grind particulate coal in the presence of the required amount of water in a single pass in order to produce coal-water suspensions. Suitable grinding equipment that can be used for this purpose includes various packed mills, such as tube mills or ball mills. According to a process described in German Pat. No. 15 26 174, in order to increase the grinding output of the mills the grinding is carried out in the presence of 50 to 65% by weight of water and the coal is ground to a fineness of 100% below approximately 1.5 mm. The suspension is then partially dehydrated so that the water content is 35 to 45% by weight.

The dehydration of the ground product following the grinding process, until the desired solids concentration is reached, requires additional process stages. It is thus very costly not only as regards the necessary apparatus but also as regards the necessary manpower requirements.

SUMMARY OF THE INVENTION

It is an object of this invention, therefore, to provide a method for producing coal-water suspensions which is not only technically simple to implement but also provides suspensions with a high solids content in which the fineness and concentration of the solids particles are so mutually adjusted that they can be satisfactorily transported, and moreover the carbonaceous content of the coal is largely converted.

The invention resides in a method for producing pumpable coal-water suspensions by a process which comprises grinding pre-comminuted particulate coal together with water in a packed mill, in a ratio corresponding to the composition of the desired suspension. The method is characterized in that the addition of water or coal is controlled by measuring the density of the suspension leaving the mill, and the grain size of the coal particles is controlled by measuring the viscosity of the suspension leaving the mill.

The aforementioned difficulties involved in producing coal-water suspensions are obviated by the new procedure by virtue of the fact that particulate coal is ground in the presence of water in the desired ratio in a packed mill and the individual parameters of the desired suspension, especially the solids concentration, grain size and viscosity, are not adjusted in isolated work stages but are instead simultaneously mutually adjusted, optionally with the addition of a suitable additive.

By pumpable coal-water suspensions are understood such two-phase systems as can be conveyed by commercially available pumps. Such pumps include e.g. plunger pumps, membrane pumps or hose-membrane piston pumps.

Hard and brown coals (lignites) from widely differing sources are suitable for producing the suspensions by the method according to the invention, and are expediently used in a precomminuted state, i.e., with a particle size of up to 50 mm. An additional pretreatment of the coal is generally not necessary, though a thermal pretreatment which reduces the volume as well as decreases the water content may be advantageous in the case of brown coal.

No special requirements are placed on the quality of the water used to produce the suspension. Even waste water charged with inorganic or organic matter may be used. Its usability is restricted simply by the level of substances which lead to the formation of environmentally harmful substances such as halogens in the combustion process, or which damage the gasification reactor and connected apparatus, such as high concentrations of inorganic substances. Waste waters formed in chemical industry production processes and containing organic matter have proved particularly suitable.

Packed mills, i.e., mills in which the comminution of the material is effected by variously shaped, variously large and variously heavy packing bodies, are used to grind the coal and to prepare the suspension. The shape, size and weight of the packing bodies and degree of packing of the mill, i.e., the ratio of the volume of the packing body filling to the empty volume of the mill, are, together with the throughput of the feedstock material itself, decisive for the grain size distribution of the ground material.

BRIEF DESCRIPTION OF THE DRAWING

Referring to the annexed drawing, there is shown a flow diagram with associated apparatuses by which the process of the invention can be conducted.

DESCRIPTION OF SPECIFIC EMBODIMENT

Referring to the drawing, 90 parts per hour of particulate coal of diameter up to 50 mm are added from a storage vessel 1 to a conveyor-type metering weigher 2. The purpose of the conveyor-type metering weigher is to meter the necessary amount of coal to a packed mill 3. At the same time, approximately 45 parts per hour of water is added via a line 18 to the mill. The amount of water is controlled by means of a regulator 4. The regulator 4 as well the measuring diaphragm 20 are connected to a ratio regulator 16. The ratio regulator 16 is for its part connected to a ratio regulator 17 responsible for the addition of additives to the water flow. The addition of additives is controlled via a pump 6, and the amount of additive added is measured by means of a measuring diaphragm 19. The ratio regulator 17 is connected to the pump 6 and also to the measuring diaphragm 19.

Lignin sulphonate, for example, is used as additive. The amount of additive is governed by the density of the suspension leaving the mill, and is generally 0.075 to 1% of additive referred to the coal.

The coal-water mixture is ground directly in the packed mill 3 to form a suspension suitable for immediate use in a coal gasification. After leaving the mill, the prepared coal-water suspension passes through a vibrating screen 8, which serves to separate foreign bodies, into a vessel 9 equipped with a stirrer. The suspension is led from this vessel 9 through a line 21 by means of a pump 14 into a storage vessel 11 equipped with a stirrer.

The viscosity and density of the suspension are measured in the line 21. The viscosity of the suspension is measured with the aid of a rotation viscosimeter 12. If the viscosity of the suspension drops, the rotation viscosimeter signals for the rotational speed of the mill to be increased, while if the viscosity of the suspension increases, the rotational speed of the mill is reduced. The rotational speed is controlled in this connection via a frequency converter 13 connected to the rotation viscosimeter. The rotational speed of the motor of the mill is controlled directly by this frequency converter 13 so that screen residues of 10 to 60% are achieved on a screen of 90 μm mesh width.

The density of the suspension is measured by a density measuring instrument 10 operating on the principle of radiometric measurement. In this, the suspension is radioactively irradiated, whereupon the suspension causes an attenuation of the radiation whose magnitude is a measure of the density being determined.

The greater the decrease in the radiation, the higher the density. The density measuring instrument 10 is connected to the ratio regulator 16 which controls the ratio of coal to water. This control of the ratio of coal to water may be effected on the one hand with a constant water amount via the conveyor-type metering weigher, and on the other hand with a constant coal amount via the amount of water from line 18 by means of the regulator 4. If the density falls, then with a constant amount of coal the addition of wster is reduced, while if the density rises the amount of water is increased.

The storage vessel 11 has a level regulating device 7. If the predetermined level in the storage vessel is reached or exceeded, the addition of coal via the conveyor-type metering weigher 2 is throttled and at the same time the amount of water is reduced. In this way it is intended to prevent the storage vessel 11 being overfilled. As soon as the level drops below the predetermined level, the amount of suspension is increased once more. The motors 15 associated with the individual units all have the same reference numerals for the sake of simplicity.

What is claimed is:

1. A process for producing a coal-water suspension useful as a feed for coal gasification which comprises mixing coal and water in a packed mill in a ratio corresponding to the ratio of the desired suspension, passing said coal-water suspension from said packed mill to another vessel, simultaneously mutually adjusting the density and viscosity of the resultant coal-water suspension by determining the density of said suspension after leaving said mill, regulating the amount of water to said mill at constant coal addition in response to a change in density of said suspension, wherein if the density of the suspension decreases, the amount of water is decreased; determining the viscosity of said suspension after leaving said mill and changing the speed of rotation of said mill in response to a change in the density; wherein if the viscosity of the suspension drops, the speed of rotation of the mill is increased.

2. A process according to claim 1 wherein the amount of water added to said mill is increased in response to an increase in said density.

3. A process according to claim 1 wherein the speed of rotation of said mill is decreased in response to an increase in said viscosity.

4. A process according to claim 1 wherein the coal fed to said mill is pre-comminuted coal.

5. A process according to claim 4 wherein the coal fed to said mill has a particle size up to 50 mm.

6. A process according to claim 1 wherein said coal-water suspension is thereafter fed to a coal gasification reactor without substantially changing the relative amount of coal and water in said suspension.

7. A process according to claim 1 wherein said suspension is produced in an essentially one-step process.

8. A process according to claim 6 wherein said coal-water suspension is produced in an essentially one-step process.

9. A process according to claim 1 wherein to said suspension there are added additives.

* * * * *

UNITED STATES PATENT AND TRADEMARK OFFICE

CERTIFICATE OF CORRECTION

PATENT NO. : 4,481,015

DATED : November 6, 1984

INVENTOR(S) : Jürgen Lusch, et al

It is certified that error appears in the above-identified patent and that said Letters Patent is hereby corrected as shown below:

| | |
|---|---|
| 1st Page, under "Inventors" | After "Duisburg", insert --Volkmar Schmidt, Oberhausen-- |

Signed and Sealed this

*Seventh* Day of *May 1985*

[SEAL]

*Attest:*

DONALD J. QUIGG

*Attesting Officer*

*Acting Commissioner of Patents and Trademarks*